United States Patent [19]

Vercelletto

[11] Patent Number: 4,603,527

[45] Date of Patent: Aug. 5, 1986

[54] PREFABRICATED WALL FOR THE CONSTRUCTION OF HOUSES AND BUILDINGS

[75] Inventor: Antoine Vercelletto, Mamers, France

[73] Assignee: Enterprise Vercelletto, Mamers, France

[21] Appl. No.: 620,082

[22] Filed: Jun. 12, 1984

[30] Foreign Application Priority Data

Jun. 21, 1983 [FR] France ..... 83 10232

[51] Int. Cl.[4] ..... E04B 2/02

[52] U.S. Cl. ..... 52/410; 52/562; 52/710; 52/712

[58] Field of Search ..... 52/410, 484, 712–715, 52/379–383, 562, 710

[56] References Cited

U.S. PATENT DOCUMENTS 1,693,572 11/1928 Blaw ..... 52/484

2,920,357 1/1960 Ericson ..... 52/484

FOREIGN PATENT DOCUMENTS 2467927 5/1981 France ..... 52/714

*Primary Examiner*—James L. Ridgill, Jr.

*Attorney, Agent, or Firm*—Young & Thompson

[57] ABSTRACT

Two panels respectively of concrete and insulating material form a prefabricated wall and are maintained in relatively spaced relation so as to form an air gap by means of coupling anchors. Each anchor head which is remote from the end to be embedded in the concrete panel is provided with notches for resilient engagement of the fastening flanges of a U-section retaining member mounted astride a row of anchor heads. The coupling anchors are disposed in planes at right angles to the axis of the retaining member.

7 Claims, 9 Drawing Figures

PREFABRICATED WALL FOR THE CONSTRUCTION OF HOUSES AND BUILDINGS

This invention relates to prefabricated walls for the construction of houses or other buildings and more particularly walls of the type in which provision is made for two panels respectively of concrete and of insulating material, these panels being joined together by means of a series of coupling elements so as to leave an air gap between said panels.

A wall of this type is described in French Pat. No. 73 20755. In this patent, the elements which provide a coupling between the two panels consist of transverse ladders, one side member of which is embedded in the concrete panel whilst the other side member serves as a support for the other insulating panel. The rungs or cross-bars of these ladders extend beyond said second side member and are engaged through the second panel or in other words the insulating panel in order to be fixed on retaining members which are mounted separately against the corresponding face of said panel.

In more precise terms, provision is made opposite to each coupling ladder for a vertically disposed metallic sectional member which is intended to serve as a common retaining member for all the cross-bars of the corresponding ladder. To this end, said sectional member has a series of slots for receiving the ends of these different cross-bars which are then bent-back in order to be fixed in position.

However, this is a relatively costly solution, on the one hand by reason of the nature of the coupling means employed and on the other hand as a result of the series of operations to be performed in order to fix the cross-bars of the different ladders on the corresponding retaining members.

It is for this reason that the object of the present invention is to produce a prefabricated wall of the same type in which the coupling means between the two panels constituting said wall are so designed as to facilitate assembly operations and to reduce the cost price of the entire wall structure.

To this end, the coupling elements provided in the prefabricated wall in accordance with the invention consist of anchoring members each having a head remote from the end which is anchored in the concrete panel. Said head is provided with notches adapted to permit resilient attachment of a sectional member having a generally U-shaped cross-section and constituting a retaining member for a series of aligned coupling anchors. Said retaining member is placed astride the corresponding heads of said coupling anchors which are disposed in planes at right angles to the axis of the corresponding retaining member. The notches are formed in the edges of the anchor heads for receiving fastening flanges provided on the side portions of the retaining member.

Thus a single retaining member can be attached to all the corresponding anchors simply by resilient engagement of said member over the anchor heads. Preferably, the retaining members thus provided are housed within grooves which are formed in the corresponding face of the insulating panel and also serve as housings for the heads of the coupling anchors.

Said sectional members are therefore flush-mounted within the insulating panel and can accordingly serve as supports for attachment of any element to be mounted separately against the respective face of said panel. By way of example, such an element can consist of a cardboard panel or of a grid which may serve as a reinforcement for an internal plaster coating or of an external coating in the case of a reverse arrangement of the wall considered.

Other features of the invention will be more apparent upon consideration of the following description and accompanying drawings, wherein.

Figure 1:
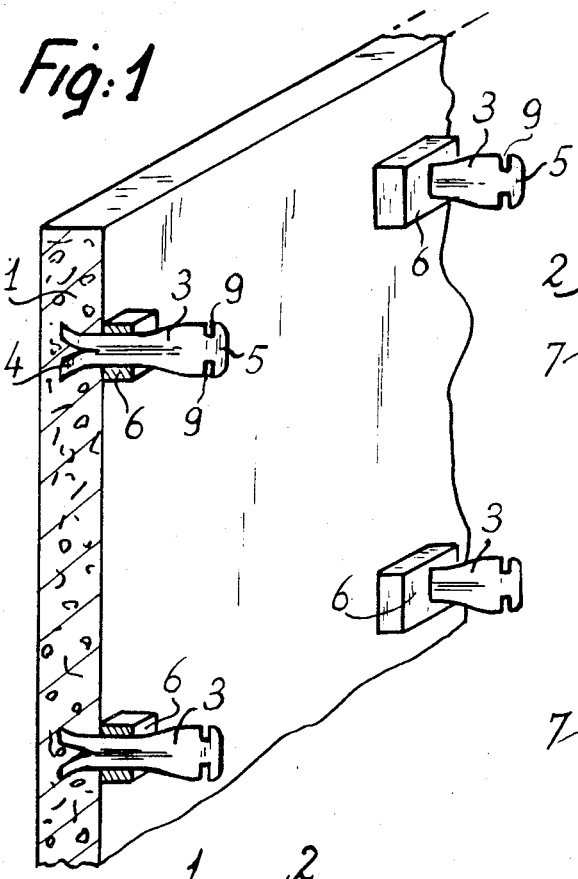
FIG. 1 is a fragmentary view in cross-section and in perspective showing the concrete panel of a wall in accordance with the invention, said panel being provided with coupling anchors which permit attachment of the insulating panel to the same wall.
Figure 2:
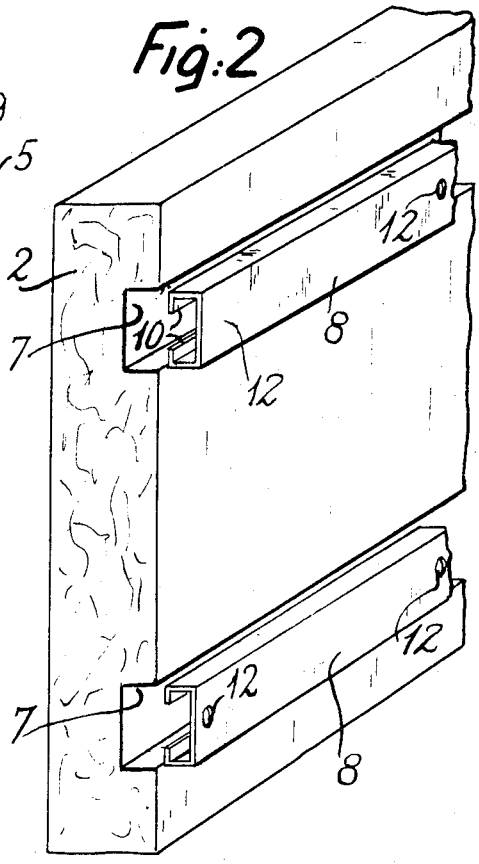
FIG. 2 is a similar view showing an insulating panel as well as one of the retaining members associated with said panel.

As mentioned earlier, the prefabricated wall in accordance with the invention is constituted by two panels 1 and 2 respectively of reinforced concrete and of insulating material, an air gap being left between said panels. The insulating panel can be made of any suitable insulating material such as, for example, polystyrene or rigid glass wool.

In accordance with the essential feature of the invention, the coupling elements employed for assembling these two panels consist of several series of coupling anchors 3 disposed in horizontal lines. One end 4 of each anchor is embedded in the concrete panel 1 whereas the opposite end or head 5 of each anchor is intended to be engaged through the insulating panel 2. The end 4 of each anchor is shaped in the same manner as a conventional masonry anchor. This end 4 is accordingly cut in the form of two tongues which are slightly opened-out and displaced with respect to the plane of the corresponding anchor plate.

A spacer block 6 formed of insulating material, for example, is engaged over the projecting portion of each anchor and has the intended function of a bearing member for the insulating panel 2 in order to maintain the requisite space with respect to the panel 1. The panel 2 is in fact joined to the panel 1 by applying the insulating panel against the concrete panel in such a manner as to ensure that the projecting heads 5 of the coupling anchors pass right through the insulating panel from one side to the other.

However, when this operation is completed and the internal face of the insulating panel 2 is applied against the spacer blocks 6, each head 5 of the coupling anchors 3 located in the same line is housed within a horizontal groove 7 formed in that face of the insulating panel 2 which is directed away from the concrete panel 1.

Provision is thus made for a series of grooves 7 of this type and each groove extends opposite to a series of coupling anchors 3 of the concrete panel 1. Each groove also serves as a housing for a metallic sectional member 8 which is intended to constitute a retaining member for the insulating panel 2.

Figure 2A:
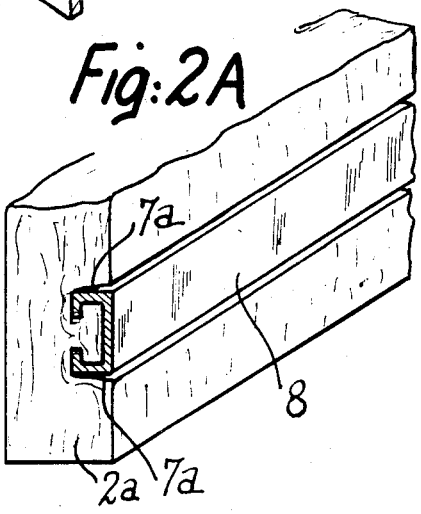
FIG. 2A is a modified view showing an insulation panel having an embedded channel inserted in grooves therein.
Figure 8:
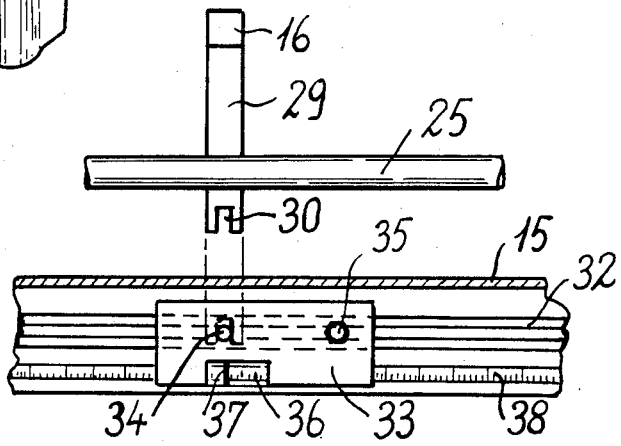
FIG. 8 is a partial view in side elevation of the table for casting the concrete panels, one of the suspension rules for the coupling anchors being shown in this figure prior to mounting above said table.

In the case of a panel 2*a* of glass wool, it is merely necessary to cut two parallel grooves 7*a* for receiving the lateral arms of the sectional member 8 (as shown in FIG. 2A). Thus the edges of said grooves are flush with the remainder of the surface corresponding to the panel 2*a*.

Figure 3:
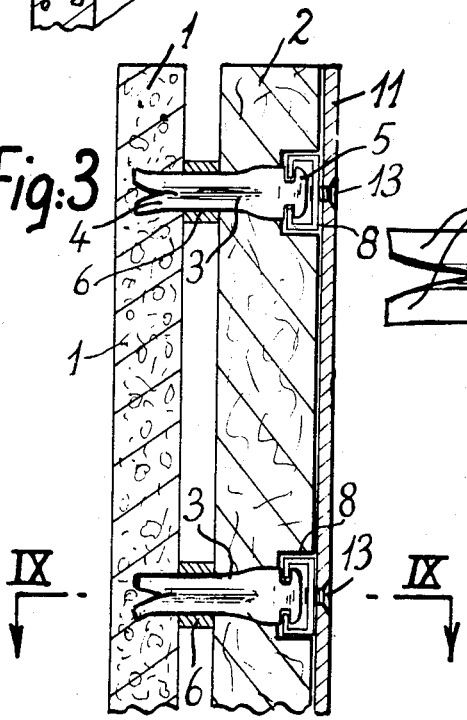
FIG. 3 is a fragmentary view in vertical cross-section showing the assembly of the two panels considered.
Figure 4:
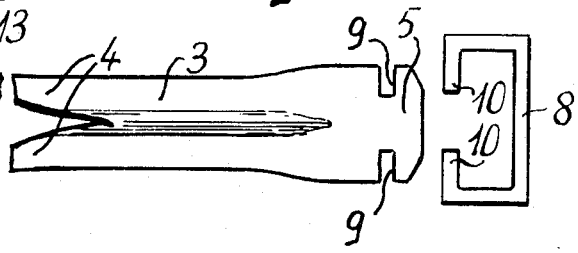
FIG. 4 is a view in side elevation showing one of the anchors for coupling these two panels and the retaining sectional member which is intended to be fastened to this latter.

It is worthy of note that the coupling anchors 3 are disposed in planes a right angles to the axis of the corresponding retaining member and that the edges of each projecting head of said anchors are provided with notches 9 for receiving fastening flanges 10 formed on the edges of each retaining member 8. The cross-section of said members 8 has the general shape of a U in order that these latter may be placed astride the projecting ends 5 of the coupling anchors as shown in FIG. 3. Engagement of the fastening flanges 10 is accordingly produced simply by force-fitting and resultant elastic deformation of the corresponding sectional member.

When this operation has been completed, the different retaining sectional members 8 are completely housed within the grooves 7 and consequently do not project from the corresponding face of the insulating panel 2. However, by virtue of the arrangement which is contemplated, said insulating panel is perfectly maintained against the spacer blocks 6 carried by the concrete panel, thus ensuring that these two panels are securely assembled together.

The retaining members 8 are also intended to serve as supports for fastening any element to be mounted separately against the corresponding face of the insulating panel 2. By way of example, such an element can consist of a gypsum board 11 fixed on the retaining members 8 by means of self-tapping screws 13. It is possible, however, to mount against the insulating panel 2 any other item of equipment such as, for example, a wire grid 14 having the function of a reinforcement for a plaster coating if the insulating panel is placed on the inside of the building to be erected (as shown in FIG. 11). On the other hand, if the arrangement is reversed, the same wire grid can serve as a reinforcement for an external coating.

Figure 5:
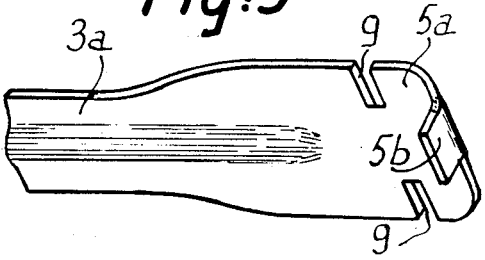
FIG. 5 is a fragmentary view in perspective showing another embodiment of a coupling anchor.

FIG. 5 illustrates an alternative embodiment of coupling anchors embedded in the concrete panel 1. The anchors 3*a* corresponding to this alternative embodiment differ from the preceding designs solely in the fact that each anchor head 5*a* is provided with a resilient tongue 5*b* which is intended to be applied against the retaining member 8, said member being attached to said coupling anchors. Thus the resilient tongue prevents any possibility of play of the board 11 or like element which may subsequently be fixed on different retaining members 8 provided in a wall in accordance with the invention. This removal of play has the advantage of preventing any noise which would otherwise be liable to occur when pressure is exerted on the wall.

In order to permit resilient fastening of the retaining means 8 on the projecting ends 5 of the coupling anchors 3, it is essential to ensure that these anchors are located at the same distance with respect to the concrete panel.

To this end, at the time of casting of the concrete panel 1 on a table 15, the different coupling anchors 3 of one and the same line are suspended by their heads from a horizontal rule 16 mounted above the table 15 in such a manner as to ensure that the opposite ends 4 of said coupling anchors are maintained at the requisite level within the mass of cast concrete until this latter has completely set. The different rules 16 thus provided are placed at their ends on rods or tubes 25 which serve as supports and extend parallel to two opposite edges of the table 15. These two tubes 25 are retractable and each tube is accordingly carried by at least two arms 26 pivotally mounted on pivot-pins 27. Thus, prior to and during the concrete casting operation, these supports can be withdrawn to one side as shown in chain-dotted lines in FIG. 6 in the case of a single arm. These supports are then raised to the vertically upright position of utilization and located at that time above the corresponding edges of the table 15 and at the desired level. The rules 16 can then be placed on the tubes 25 so as to ensure that the ends 4 of the coupling anchors carried by said rules are embedded within the concrete.

The rules 16 are fitted with vertical end lugs 28 forming stops to be placed outside the tubes 25 which serve as supports for said rules, thus ensuring suitable positioning of these latter. Opposite to each stop, however, each rule 16 is adapted to carry a downwardly-extending vertical arm 29 of substantially greater length and provided with a notch 30 at the lower end thereof. This lower end of the arm is intended to be fixed on a position-adjustment slide plate 33 comprising a stud 34 which is capable of engaging within the notch 30. Said slide plate forms part of a series of similar plates slidably mounted on a rail 32 provided on each side face 15*a* of the concrete-casting table 15 and extending in a direction parallel to a graduated rule 38.

Each slide plate 32 has a recess 36 fitted with a transparent cover on which is marked a reference line 37, the axis of which passes through the stud 34. Said reference line is located opposite to the graduated scale of the rule 38, thus permitting highly accurate adjustment of the positions of the slide plates 33 and consequently the positions of the rules 16 carried by these latter, the ends of the rules being capable of sliding along their supporting tubes 25. Thus said rules can be disposed at precise intervals over the length of the table 15 and each rule can be located exactly at right angles to the side faces of said table. A clamping screw 35 serves to lock the slide plates 33 in the desired position.

It should be pointed out that this arrangement may also be employed for positioning the molds which serve to separate the different cast concrete panels 1 on the table 15.

The equipment unit described achieves perfect alignment of the corresponding coupling anchors and the desired positioning of their projecting heads 5. These anchors are thus maintained in the corresponding position throughout the time of setting of the concrete which forms the panel 1.

Figure 6:
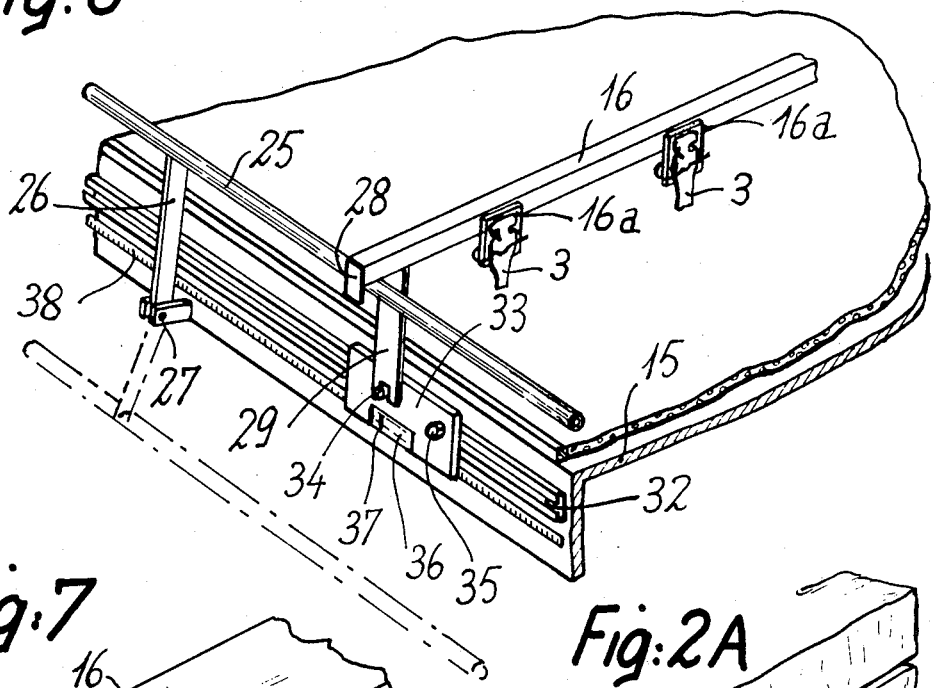
FIG. 6 is a schematic view in perspective illustrating the method of fabrication of the concrete panel and the equipment employed.
Figure 7:
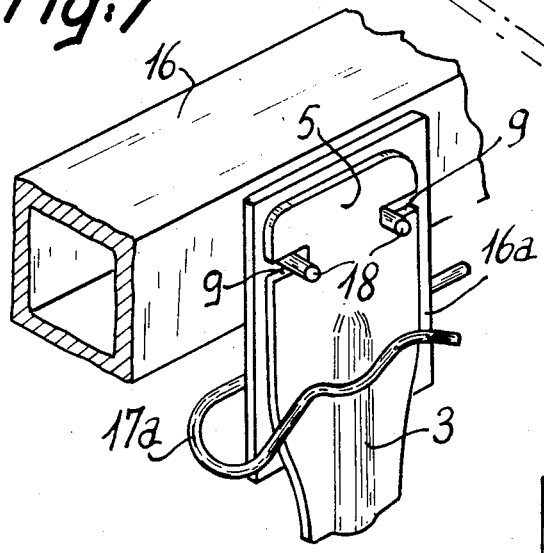
FIG. 7 is a fragmentary view in perspective showing the mode of temporary attachment of one of the coupling anchors to the rule which is employed as a suspension support for a series of anchors which are intended to be placed in one line.

The coupling anchors 3 are temporarily fixed on the rule 16 by means of their projecting heads 5 in order that they may subsequently be detached without difficulty. This attachment is effected by means of a series of vertical plates 16*a* mounted separately against one of the longitudinal faces of the rules 16. Each temporary attachment plate, which is placed in the intended position of a coupling anchor 3, is adapted to carry two small studs 18 which are intended to be engaged within the notches 9 of the projecting end 5 of a coupling anchor 3 as shown in FIGS. 6 and 7.

Thus the different coupling anchors of any one line can readily be fixed in position against a suspension rule 16 by applying the end 5 of each anchor against a vertical plate 16*a* so that the studs 18 penetrate into the notches 9. However, the temporary attachment of each coupling anchor 3 can be completed by positioning a small wire clip 17*a*. After solidification of the concrete of the panel 1, the rules 6 can be readily detached from the different anchors 3 which are then rigidly and permanently fixed in said panel.

The walls in accordance with the invention are not limited solely to the example of construction described in the foregoing.

From this it follows that, instead of being disposed in horizontal lines, the coupling anchors 3 could be disposed at intervals in vertical lines, in which case the retaining members 8 would also be disposed vertically. It will be readily understood that, in such a case, the coupling anchors 3 should be placed along horizontal planes and no longer along vertical planes. It is finally worthy of note that, when employed for the construction of the wall of a house or any other building, the prefabricated walls in accordance with the invention can be oriented by placing either their concrete panel or their panel of insulating material on the outside.

What is claimed is:

1. A prefabricated wall constituted by two panels respectively of concrete and of insulating material, said panels being joined together by means of a series of coupling elements so as to leave an air gap between said panels, each coupling element being carried at one end by the concrete panel, engaged at the other end through the insulating panel and joined on the other side of said insulating panel to a retaining member placed against the corresponding face of said panel, wherein the coupling elements consist of anchors each having a head remote from the end which is embedded in the concrete panel, said head being provided with notches adapted to permit resilient attachment of a sectional member having a generally U-shaped cross-section and constituting a retaining member for a series of coupling anchors in aligned relation, said retaining member being placed astride the corresponding heads of the coupling anchors, said anchors being disposed in planes at right angles to the axis of the corresponding retaining member whilst the notches are formed in the edges of the anchor heads for receiving fastening flanges provided on the side portions of said retaining member, and spacers carried by the coupling elements and in contact both with the concrete panel and with the insulating panel thereby to maintain said air gap.

2. A prefabricated wall according to claim 1, wherein the head of each coupling anchor is provided with a resilient tongue having the function of preventing any possibility of play by exerting pressure on the retaining member which is attached to said head.

3. A prefabricated wall according to claim 1, and sheet material secured by screws to said sectional member on the side of said insulating panel opposite said concrete panel.

4. A prefabricated wall constituted by two panels respectively of concrete and of insulating material, said panels being joined together by means of a series of coupling elements so as to leave an air gap between said panels, each coupling element being carried at one end by the concrete panel, engaged at the other end through the insulating panel and joined on the other side of said insulating panel to a retaining member placed against the corresponding face of said panel, wherein the coupling elements consist of anchors each having a head remote from the end which is embedded in the concrete panel, said head being provided with notches adapted to permit resilient attachment of a sectional member having a generally U-shaped crosssection and constituting a retaining member for a series of coupling anchors in aligned relation, said retaining member being placed astride the corresponding heads of the coupling anchors, said anchors being disposed in planes at right angles to the axis of the corresponding retaining member whilst the notches are formed in the edges of the anchor heads for receiving fastening flanges provided on the side portions of said retaining member, said coupling elements being of one piece construction of sheet material disposed in planes perpendicular to the length of said sectional member of U-shaped cross-section.

5. A prefabricated wall according to claim 4, and sheet material secured by screws to said sectional member on the side of said insulating panel opposite said concrete panel.

6. A prefabricated wall constituted by two panels respectively of concrete and of insulating material, said panels being joined together by means of a series of coupling elements so as to leave an air gap between said panels, each coupling element being carried at one end by the concrete panel, engaged at the other end through the insulating panel and joined on the other side of said insulating panel to a retaining member placed against the corresponding face of said panel, wherein the coupling elements consist of anchors each having a head remote from the end which is embedded in the concrete panel, said head being provided with notches adapted to permit resilient attachment of a secional member having a generally U-shaped crosssection and constituting a retaining member for a series of coupling anchors in aligned relation, said retaining member being placed astride the corresponding heads of the coupling anchors, said anchors being disposed in planes at right angles to the axis of the corresponding retaining member whilst the notches are formed in the edges of the anchor heads for receiving fastening flanges provided on the side portions of said retaining member, said sectional member of U-shaped cross-section being disposed in a groove in said insulating panel, said groove being disposed on the side of said insulating panel opposite said concrete panel and having a depth substantially less than the thickness of said insulating panel and opening in a direction away from the concrete panel.

7. A prefabricated wall according to claim 6, and sheet material secured by screws to said sectional member on the side of said insulating panel opposite said concrete panel.

* * * * *